United States Patent [19]

Kono

[11] 4,087,980

[45] May 9, 1978

[54] SAFETY SUBMARINE SPHERICAL AIR CHAMBER

[76] Inventor: Yutaka Kono, No. 18-27, 1-chome, Asahi-cho, Nerima-Ku, Tokyo, Japan

[21] Appl. No.: 716,874

[22] Filed: Aug. 23, 1976

[51] Int. Cl.[2] ..... B63C 11/00

[52] U.S. Cl. ..... 61/69 R; 114/16 R; 114/257

[58] Field of Search ..... 61/69 R, 69 A, 86; 114/16R, 16.4, 257, 264

[56] References Cited

U.S. PATENT DOCUMENTS

| | | | |
|---|---|---|---|
| 1,016,808 | 2/1912 | Williamson | 61/69 R |
| 3,299,645 | 1/1967 | Link | 61/69 R |
| 3,415,068 | 12/1968 | Casey, Jr. et al. | 61/69 R |
| 3,475,915 | 11/1969 | Caplan | 61/69 R |
| 3,706,206 | 12/1972 | Clark | 61/69 R |
| 3,708,991 | 1/1973 | Barkley | 61/69 R |

*Primary Examiner*—Jacob Shapiro

[57] ABSTRACT

This invention relates to a safety submarine spherical air chamber made of a flexible material wherein persons are able to observe the undersea condition and the seabed from the scientific or recreational point of view by maintaining the atmospheric pressure of the above spherically expanded chamber approximately equivalent to the sea water pressure therearound, and then by floating therein a floating base on which they can stay.

8 Claims, 5 Drawing Figures

SAFETY SUBMARINE SPHERICAL AIR CHAMBER

BACKGROUND OF THE INVENTION

In order to observe the undersea condition and the seabottom from the scientific or recreational point of view, some specific devices have been developed and are being used practically.

In order that men can observe in a specific device the undersea condition and the seabottom from the recreational point of view, it is indispensable for such a device to solve various questions like the question of water pressure, the question of safety, the question of air supply to the device submerged etc.

This invention is to provide a safety submarine spherical air chamber which has overcome and foregoing difficult questions.

BRIEF SUMMARY OF THE DESCRIPTION

It is therefore a general object of this invention to provide a safety submarine spherical air chamber made of a flexible material wherein persons are able to observe the undersea condition and the seabed from the scientific or recreational point of view by maintaining the atmospheric pressure of the above spherically expanded chamber approximately equivalent to the sea water pressure therearound, and then by floating therein a floating member on which they can stay.

It is another object of this invention to provide a safety submarine spherical air chamber in which persons can go down thereto or come up therefrom by riding in a lift or other preferred flexible pipe through which they can pass.

It is another object of this invention to provide a safety submarine air chamber which is made of a flexible synthetic resin material like a vinyl, and formed spherically so that the sea water pressure around the air chamber can be uniformly applied to the superficial wall thereof.

It is another object of this invention to provide a safety submarine spherical air chamber which is provided with a chamber of higher atmospheric pressure and a chamber of lower atmospheric pressure neighboring therewith at the exit where persons go down to the said air chamber or come up therefrom for the purpose of preventing the so-called submarine sickness which takes place at the time when they enter the open air from the said air chamber.

These and other objects, advantages, features, and uses will become more apparent as the description proceeds, when considered with the accompanying drawings.

DETAILED DESCRIPTION OF THE INVENTION

Three examples of a safety submarine spherical air chamber according to this invention will now be described with reference to the accompanying drawings.

Figure 1:
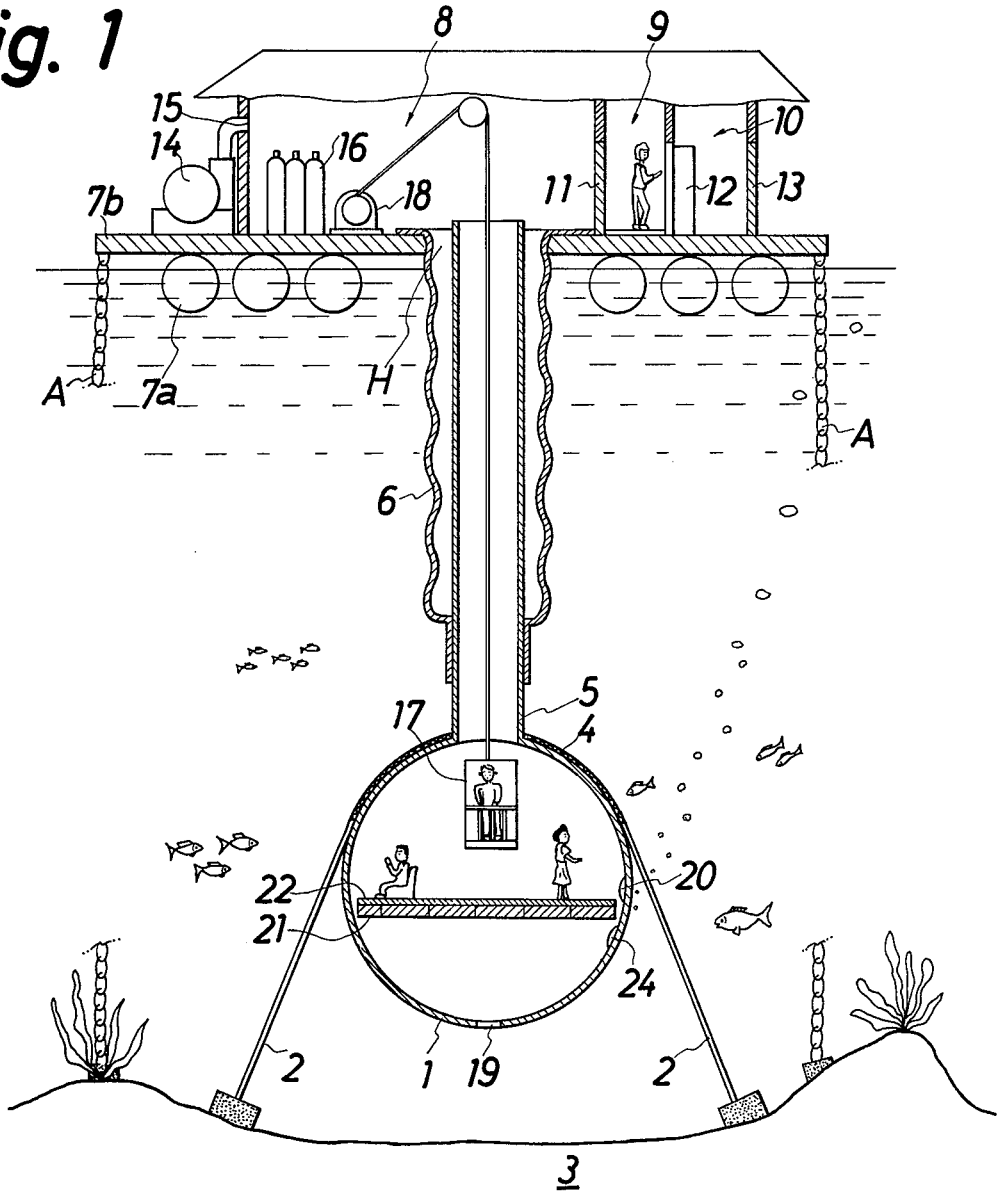
FIG. 1 is a detail view of an embodiment of a safety submarine spherical air chamber according to this invention.
Figure 2:
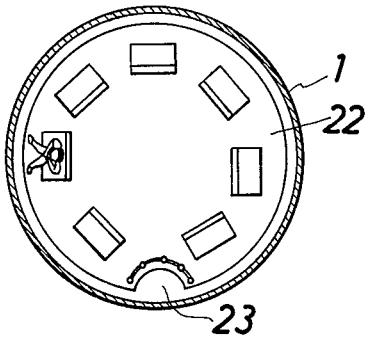
FIG. 2 is a transverse section view of a body of the safety submarine spherical air chamber in FIG. 1.

Referring first to FIG. 1, there is shown a submarine spherical air chamber which is made of a transparent synthetic resin material like vinyl and submerged at a depth of about 10m to 15m from the sea surface. The air chamber 1 is expanded spherically due to compressed air. To prevent the air chamber's own buoyancy, the air chamber 1 is covered by a net 4 and secured by a supporting rope 2 with the seabed 3. The air chamber 1 is communicated to a flexible hollow-type pipe 5 which is protected by an expansible bellows-type defense 6 so that the air body 1 can not be moved upwardly and downwardly. The preferred length and shape of the bellows-type tubular defense 6 shall be decided in accordance with the depth of the submerged air chamber 1 and the wave condition.

Numeral *7b* is a base which is floated on a plurality of floating members *7a* and is secured by supporting members A with the seabed 3. On the base *7b* there are mounted three adjacent chambers each of which is an air-tight chamber by covering vinyl or the like on the internal wall thereof. Of those air-tight chambers numeral 8 is a chamber of higher atmospheric pressure which is filled with the same atmospheric pressure as the sea water pressure applied to the submerged air chamber 1. For instance, since the air chamber 1 is situated at a depth of 15m, the water pressure applied thereto is 1.5 atmospheric pressure. Accordingly, the atmospheric pressure of the chamber 8 is to be 1.5. Next to this chamber 8 there is provided a chamber 9 of high atmospheric pressure approximately equivalent to the atmospheric pressure of the chamber 8. Next to this there is provided the last chamber 10 of lower atmospheric pressure of 0.35 to 0.45. These three air-tight chambers 8,9,10 are provided in order to prevent the so-called submarine sickness. Thus, persons who stayed in the submerged spherical air chamber 1 can go to the open air after having passed through these three chambers one after another. The degree of atmospheric pressure of these chambers shall be adjusted in accordance with the depth of submergence of the air chamber 1. When they pass through the above three chambers, there are provided the doors 11,12,13 respectively. Numeral 14 is an air compressor connected to an air supply opening 15. At the event that the air compressor 14 will malfunction, there are stored a plurality of containers filled with compressed air for emergency. Numeral 17 is a lift which is operated by a driving device 18. By riding in the lift 17, persons can go down to the air chamber 1 or come up therefrom.

Referring to the structure of the spherical air chamber 1, numeral 19 is a sea water induction hole which is formed at the bottom of the air chamber 1. The lower part of the air chamber 1 is filled with sea water induced by the hole 19. The compressed air is supplied to the air chamber 1 by way of the pipe so as to maintain the atmospheric pressure of the air chamber 1 approximately equivalent to the sea water pressure around the air chamber 1. Numeral 20 is a hole formed on the lower internal wall of the air chamber 1. When the atmospheric pressure within the air chamber 1 became just equivalent to the pressure of the sea water therearound, the surplus compressed air can be discharged to the outside sea through the hole 20, and then air bubbles are coming up to the surface. Accordingly, the persons in the air chamber 1 and operators on the base *7b* can acknowledge that the compressed air is normally and sufficiently filled in the air chamber 1. Further, since dirty air can be discharged through the hole 20, the air within the air chamber 1 can be always kept clean.

Numeral 21 is a floating member which is floatable within the air chamber 1 and covered by a flat fixing material 22. Numeral 23 is an entrance formed at one edge of the floating member 21. Numeral 24 is an air discharging hole for emergency which is always formed below the floating member 21.

The operation of the submarine spherical air chamber 1 will now be described. First, a flexible and expansible material of the air chamber 1 connected to a flexible material of the pipe 5 as well as of the bellows-type defense 6 is submerged beneath the preferred sea. The opening of the pipe 5 is provided at the bottom of the chamber 8. The opening of the bellows-type defense 6 are air-tightly fixed with the base *7b*. Further, the air chamber 1 covered by a net 4 is secured to the seabed 3 by a suppoting rope 2.

Then, the compressed fresh air of the air compressor 14 is fed into the flexible and expansible material of the air chamber 1 by way of the opening 15, the chamber 8 and finally the pipe 5. As a result, the pipe 5 and the defense 6 are expanded to a preferred shape, and the air chamber 1 is expanded spherical as shown in FIG. 1. The atmospheric pressure of each of the pipe 5, the defense 6 and the spherical air chamber 1 is to be approximately equal to the pressure of the sea water therearound.

Next to this, the floating member 21 is floated on the sea water filled up to the central lower level of the air chamber 1. The floating member 21 is made of a flexible material expanded by air or made of a sheet passable through the pipe 5. To make uniformly the surface of the floating member 21, a float fixing member 22 is mounted on the floor on which some necessary fixtures are set. Also, interior work shall be done. Thus, by using a lift 17, persons can go down to or up from the spherical air chamber 1.

A swimmer equipped with an aqualung can enter the air chamber 1 through the opening 19 provided at the bottom thereof, and land on the floor 22 from the entrance 23. After having ended the undersea observation, viewers go up by the lift 17 and land in the chamber 8 of higher atmospheric pressure. The chamber 8 of higher atmospheric pressure is set to be approximately equal to that of the air chamber 1 (in case of this embodiment 1.5 atmospheric pressure). Therefore, even if they go up quickly to the base *7b*, they are free from any bad affects on their body. After having stayed after a short while in the chambers 8,9, they enter the last chamber 10 of lower atmospheric pressure of 0.45 to 0.35. After a short rest therein, they enter the open air. Accordingly, they are completely free from any submarine sickness and can enjoy the undersea view in this safety submarine spherical air chamber. In the event that the spherical air chamber 1 is about to surface by some accidents, the floating member 21 is lowered below the air discharging hole 24 for emergency, and then the surplus compressed air is discharged to the outside sea. Thus, the spherical air chamber 1 is maintained safely.

When withdrawing or evacuating the spherical air chamber 1, after having taken out the fixtures, it is required to stop air supply and discharge the compressed air from the air chamber 1. This is a simple operation.

SECOND EMBODIMENT

Figure 3:
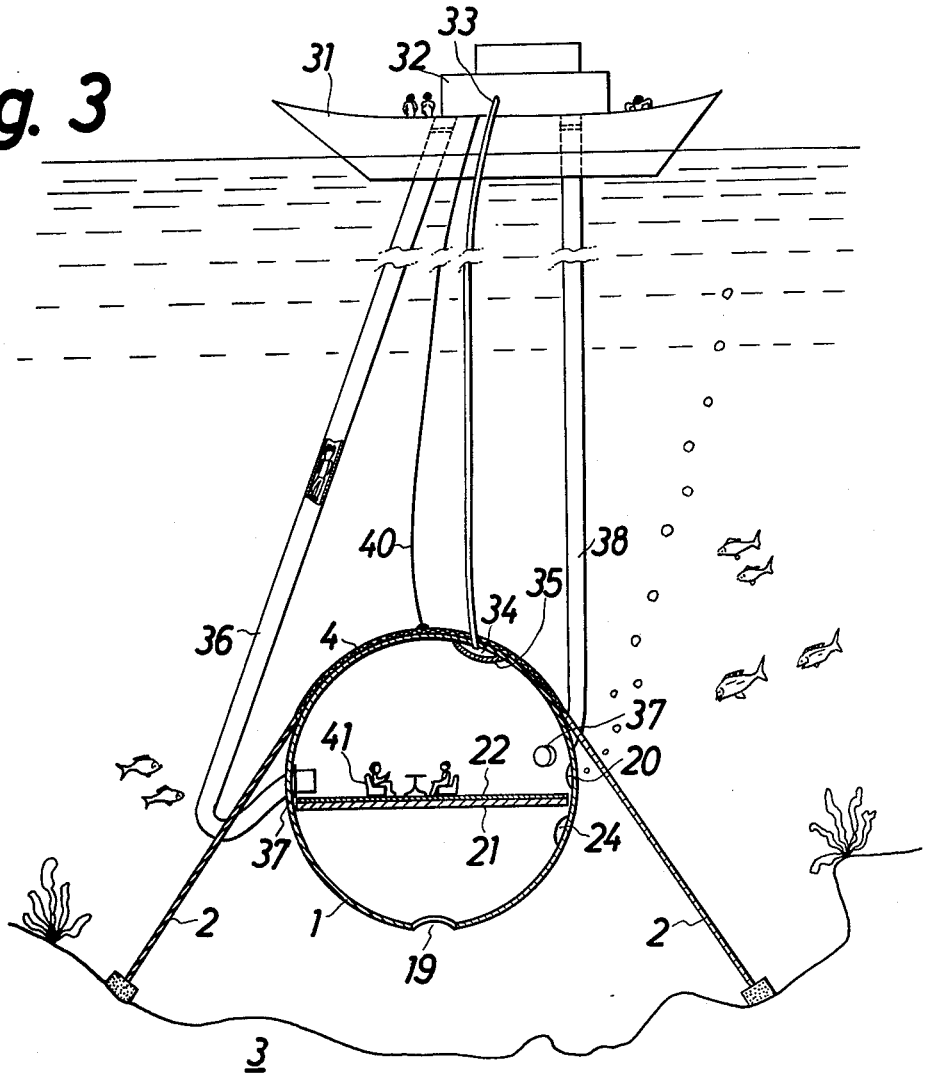
FIG. 3 is a detail view of another embodiment of the safety submarine spherical air chamber.
Figure 4:
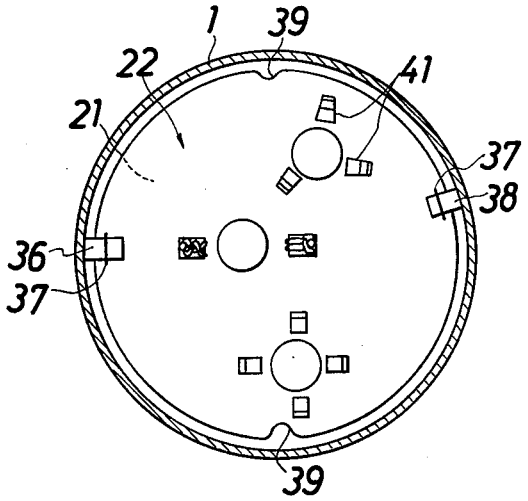
FIG. 4 is a transverse section view of a body of the air chamber of FIG. 3.

In this embodiment (shown in FIGS. 3 and 4), the submarine spherical air chamber 1 is submerged at a depth of 10m to 30m. Compressed fresh air is supplied to the air chamber 1 from an air compressor 32 installed in a boat 31 by way of an air feeding pipe 33. Accordingly, the atmospheric pressure of the air chamber 1 is set to be approximately equal to the sea water pressure therearound. Numeral 34 is an air feeding opening on the top of the air chamber 1, by which there is provided a non-return valve 35 so that the air within the air chamber 1 can not flow backward to the pipe 33.

Numeral 36 is an entry passage of tubular shape which is made of a flexible material like vinyl or rubber. The upper end of the entry passage is communicated to the boat 31, while the last end is passed through the wall of the spherical air chamber 1. The bottom part of the entry passage 36 is kept lower than the level of the floor 22, and the last end of the entry passage is mounted on the floor 22. A non-return valve 37 is provided at the last end of the entry passage 36 so that the air within the air chamber 1 can not flow backward to the entry passage 36.

Numeral 38 is an exit passage of tubular shape which is made of a flexible material like the entry passage 36. The last end of the exit passage 38 communicated to the boat 31 is also passed through the wall of the spherical air chamber 1. In the same way, another non-return valve 37 is provided at the last end of the exit passage 38. In the exit passage there is provided a rope-made ladder or the like (not shown in FIG. 3) so that persons can come up from the air chamber 1. Numeral 39 is an entrance formed at an edge of the floor 22, from which a swimmer equipped with an aqualung can land on the floor 22. Numeral 40 is a strong rope which supports the spherical air chamber. Numeral 41 is furniture which is set on the floor 22. The other numerals are the same as the first embodiment.

The operation of the safety submarine spherical air chamber 1 according to the second embodiment will now be described. First of all, a flexible and expansible material of the spherical air chamber 1 connected with the same flexible and expansible material of the entry passage *3b* as well as if the exit passage 38 is submerged beneath the preferred sea, and is secured to the seabed 3 by the supporting rope 2. Then, the compressed fresh air of the air compressor 32 is fed to the flexible material of the air chamber 1 by way of the air feeding pipe 33. As a result, the entry passage 36 and the exit passage 38 are expanded to a preferred shape, and the air chamber 1 is expanded spherical. Then, the sea water induced from the hole 19 is filled up to the central lower level of the air chamber 1. And the floating member 21 is floated on the induced sea water.

When a person enters the air chamber 1 from the boat 31, he or she can slide down slowly the entry passage. When the person comes up from the air chamber 1, he can use the rope-made ladder or other preferred means.

Further, the swimmer equipped with an aqualung can enter the air chamber 1 from the opening 19.

Since the other numerals have the same function as the first embodiment, the description will be omitted.

THIRD EMBODIMENT

Figure 5:
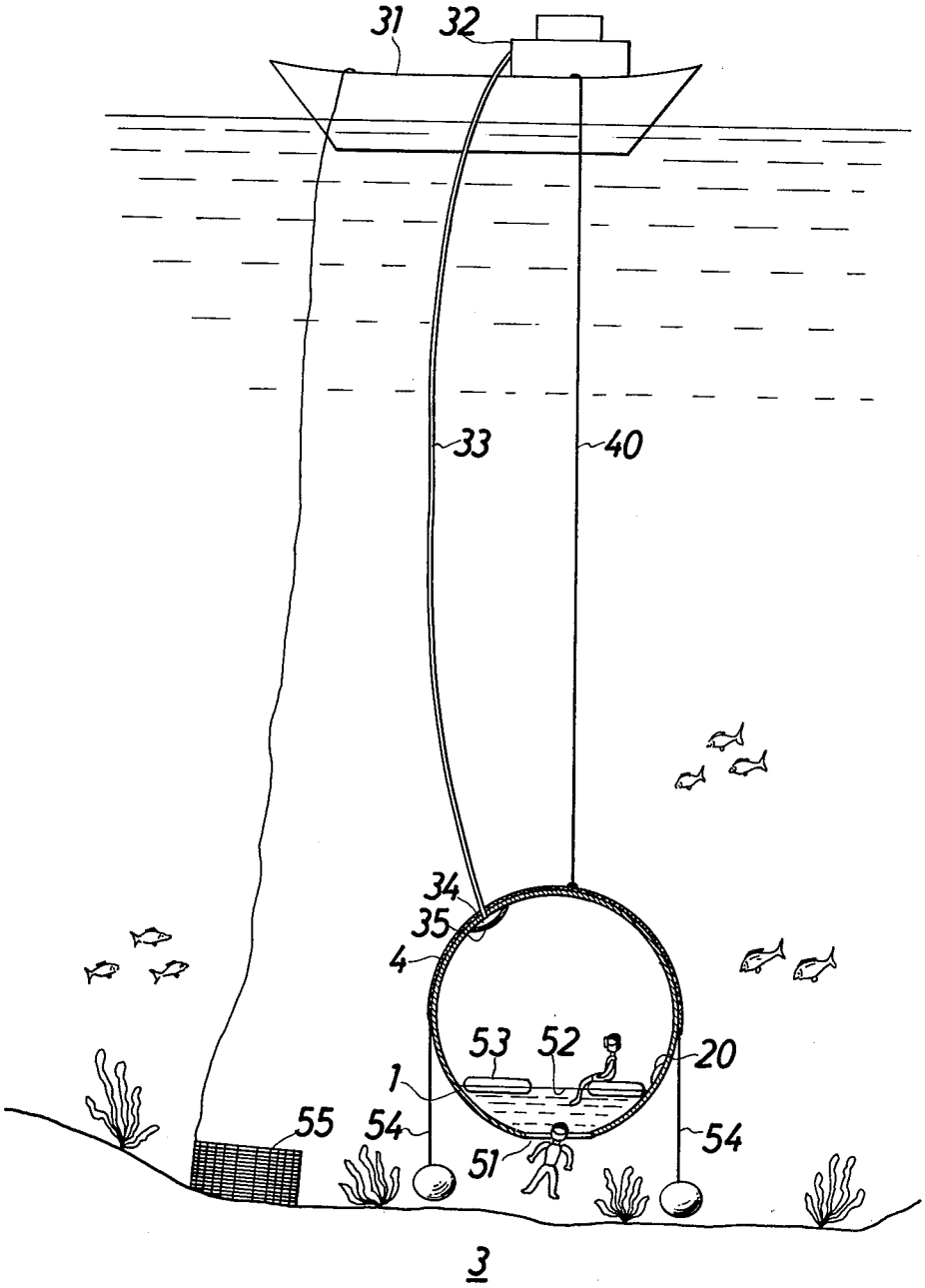
FIG. 5 is a detail view of another embodiment of the safety submarine spherical air chamber.

The spherical air chamber 1 of the third embodiment (shown in FIG. 5) is used particularly for the persons who work beneath the sea. For instance, persons who collect various shellfishes or divers are obliged to work for a long time beneath the sea. When they feel tired or difficult in breathing, they come up to the sea surface and breathe fresh outer air. In order to reduce such lost time, the submarine spherical air chamber 1 is provided in FIG. 5. It is submerged at a depth of about 20m.

Numeral 55 is a box in which the persons or the drivers working beneath the sea can store shellfishes or other necessary things. If they want to take a rest, they can enter the air chamber 1 from an entrance 51. Just like the second embodiment, the compressed fresh air is fed to the air chamber 1 from the compressor 31 by way of the air feeding pipe 33. And the sea water is induced up to the lower level 52 of the spherical air chamber 1. On the sea surface 52 there is floated a floating member 53. Under the above structure, a diver or a person collecting shellfishes can take fresh air and sufficient rest, sitting on the floating member 53 within the air chamber 1. Thus, they are free from suffering the so-called submarine sickness.

In order to maintain the air body 1 in the sea or not to move it upwardly, there is provided an anchor 54 suspending from both ends of the air chamber 1. Accordingly, the air chamber 1 is not moved by a tidal current or the like. Also, the entrance 51 is always maintained downwardly, so that the air chamber 1 is always stabilized.

By using this safety submarine spherical air chamber 1, the divers working for a long time in the sea can take sufficient rest therein and continue safe and efficient working in the sea.

Since the atmospheric pressure of the safety submarine spherical air chamber is kept equivalent to the water pressure therearound by a preferred means, the viewers can observe safety the undersea condition and the seabed from the scientific or recreational point of view, and the divers can take a sufficient rest.

Further, since the spherical air chamber according to this invention is of simple structure, it is not costly to produce such a device.

It is to be understood that the form of this invention herein shown and described is to be taken as a preferred example of the same and that various changes in the shape, size and arrangement of parts may be resorted to without departing from the spirit of this invention or the scope of the subjoined claims.

What is claimed is:

1. A safety submarine device comprising an air chamber body constituted entirely of a transparent flexible air-tight material and capable when inflated of assuming a spherical shape, an air feeding pipe connected to said air chamber, air supply means for filling said air chamber with compressed fresh air to cause said air chamber to form a spherical shape, personnel ascent and descent means connected to said air chamber, a sea water induction hole through which personnel can pass, means for adjusting the atmospheric pressure within the air chamber to substantially match the surrounding water pressure when submerged and to allow water to enter and fill a lower portion of the chamber through the sea water induction hole, a plurality of supporting members connected to the air chamber for maintaining stably said spherical air chamber in the sea, the atmospheric pressure adjusting means comprising an opening in the air chamber body through which excess compressed air within the air chamber can be discharged to the outside sea, and personnel supporting means provided within the air chamber and floatably supported on the water therein.

2. A safety submarine device as claimed in claim 1, wherein said personnel ascent and descent means comprises a lift.

3. A safety submarine device as claimed in claim 1, wherein said personnel ascent and descent means comprises a flexible pipe through which personnel can pass.

4. A safety submarine device as claimed in claim 1, wherein the air chamber body is constituted of a synthetic resin material.

5. A safety submarine device as claimed in claim 1, wherein an additional air-discharging opening is provided in the air chamber below the level of the floating personnel supporting means.

6. a safety submarine device comprising an air chamber body constituted entirely of a transparent flexible air-tight material and capable when inflated of assuming a spherical shape, an air feeding pipe connected to said air chamber, air supply means for filling said air chamber with compressed fresh air to cause said air chamber to form a spherical shape, personnel ascent and descent means connected at its lower end to said air chamber, means for adjusting the atmospheric pressure within the air chamber to substantially match the surrounding water pressure when submerged, a plurality of supporting members connected to the air chamber for maintaining stably said spherical air chamber in the sea, first, second and third successive pressure-sealable chambers connected to the upper end of the personnel ascent and descent means, and means for maintaining said three successive chambers at different pressures for preventing submarine sickness.

7. A safety submarine device as claimed in claim 6, wherein the first and second pressure-sealable chambers are maintained at substantially the same pressure as that of the air chamber, and the third pressure-sealable chamber is maintained at a pressure below normal atmospheric pressure.

8. A safety submarine device as claimed in claim 6, wherein the atmospheric pressure adjusting means comprises a plurality of air-discharging openings.

* * * * *